US009022277B2

(12) United States Patent
Hendricks et al.

(10) Patent No.: US 9,022,277 B2
(45) Date of Patent: May 5, 2015

(54) CARRIER WITH LOCKING FEATURES

(75) Inventors: Timothy W. Hendricks, Acworth, GA (US); Raymond R. Spivey, Sr., Mableton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 261 days.

(21) Appl. No.: 13/450,903

(22) Filed: Apr. 19, 2012

(65) Prior Publication Data

US 2012/0267426 A1 Oct. 25, 2012

Related U.S. Application Data

(60) Provisional application No. 61/517,479, filed on Apr. 20, 2011.

(51) Int. Cl.

| | |
|---|---|
| ***B65D 5/04*** | (2006.01) |
| ***B31B 1/50*** | (2006.01) |
| ***B65D 5/42*** | (2006.01) |
| ***B65D 71/16*** | (2006.01) |

(52) U.S. Cl.

CPC ..... *B65D 71/16* (2013.01); *B65D 2571/00166* (2013.01); *B65D 2571/00172* (2013.01); *B65D 2571/0066* (2013.01); *B65D 2571/00716* (2013.01); *B65D 2571/00302* (2013.01)

(58) Field of Classification Search

USPC ..... 229/128; 206/140, 139, 161; 493/137

See application file for complete search history.

(56) References Cited

U.S. PATENT DOCUMENTS

| | | | |
|---|---|---|---|
| 2,849,111 | A | 8/1958 | Fielding |
| RE24,667 | E | 7/1959 | Fielding |
| 2,922,561 | A | 1/1960 | Currivan |
| 2,928,541 | A | 3/1960 | Fielding |
| 2,929,497 | A | 3/1960 | De Million-Czarnecki |
| 3,128,010 | A | 4/1964 | Forrer |
| 3,156,404 | A | 11/1964 | Wood |
| 3,178,242 | A | 4/1965 | Ellis |
| 3,194,476 | A | 7/1965 | Weiss |

(Continued)

FOREIGN PATENT DOCUMENTS

| | | |
|---|---|---|
| BE | 671762 | 3/1966 |
| CA | 2542350 | 5/2005 |

(Continued)

OTHER PUBLICATIONS

International Search Report and Written Opinion for PCT/US2012/060982 dated Mar. 28, 2013.

(Continued)

*Primary Examiner* — Christopher Demeree

(74) *Attorney, Agent, or Firm* — Womble Carlyle Sandridge & Rice, LLP

(57) ABSTRACT

A carrier for holding a plurality of articles. The carrier comprises a plurality of panels that extend at least partially around an interior of the carton. The plurality of panels comprises a first bottom panel and a second bottom panel. At least one locking feature comprises a female locking feature in the first bottom panel and a male locking feature in the second bottom panel. The female locking feature comprises a locking flap, and the male locking feature comprises a retention feature. At least a portion of the male locking feature engages the female locking feature, and at least a portion of the locking flap at least partially engages the retention feature.

37 Claims, 9 Drawing Sheets

(56) References Cited

U.S. PATENT DOCUMENTS 3,229,892 A 1/1966 Weiss
3,237,762 A 3/1966 Wood
3,252,649 A 5/1966 Garser et al.
3,278,075 A 10/1966 Weiss
3,300,115 A 1/1967 Schauer
3,306,519 A 2/1967 Wood
3,339,723 A 9/1967 Wood
3,343,660 A 9/1967 Bailey
3,355,012 A 11/1967 Weiss
3,356,279 A 12/1967 Root
3,367,557 A 2/1968 Farquhar
3,373,867 A 3/1968 Wood
3,375,968 A 4/1968 Weiss
3,429,496 A 2/1969 Hickin
3,447,672 A 6/1969 Bailey
3,462,011 A 8/1969 Farquhar
3,517,858 A 6/1970 Farquhar
3,517,876 A 6/1970 Stout
3,593,849 A 7/1971 Helms
3,635,452 A 1/1972 Helms
3,655,117 A 4/1972 Weiss
3,669,342 A 6/1972 Funkhouser
3,669,343 A 6/1972 Howard
3,715,029 A 2/1973 Wood
3,747,835 A 7/1973 Graser
3,767,042 A 10/1973 Ganz
3,963,121 A 6/1976 Kipp
4,004,500 A 1/1977 Wood
4,010,593 A 3/1977 Graham
4,032,053 A 6/1977 Wilson
4,096,985 A 6/1978 Wood
4,101,069 A 7/1978 Wood
4,200,220 A 4/1980 Ganz
4,202,446 A 5/1980 Sutherland
4,215,781 A 8/1980 Humphries et al.
4,328,893 A 5/1982 Oliff et al.
4,355,717 A 10/1982 Oliff
4,382,505 A 5/1983 Sutherland et al.
4,394,903 A 7/1983 Bakx
4,421,232 A 12/1983 Konaka
4,424,901 A 1/1984 Lanier
4,440,340 A 4/1984 Bakx
4,533,047 A 8/1985 Calvert
4,545,485 A 10/1985 Oliff
4,566,593 A 1/1986 Muller
4,574,997 A 3/1986 Ikeda
4,611,754 A 9/1986 Sutherland
4,708,284 A 11/1987 Sutherland et al.
4,747,487 A 5/1988 Wood
4,784,266 A 11/1988 Chaussadas
4,804,089 A 2/1989 Wilson
4,815,599 A 3/1989 Schuster
4,836,375 A 6/1989 Schuster
4,844,328 A 7/1989 Cooper
4,860,943 A 8/1989 Cooper
4,878,612 A 11/1989 Schuster
4,901,849 A 2/1990 Wilson
4,919,266 A 4/1990 McIntosh, Jr. et al.
4,966,324 A 10/1990 Steel
4,972,991 A 11/1990 Schuster
5,000,313 A 3/1991 Oliff
5,042,660 A 8/1991 Carver
5,060,792 A 10/1991 Oliff
5,060,804 A 10/1991 Beales et al.
5,094,347 A 3/1992 Schuster
5,131,588 A 7/1992 Oliff
5,180,100 A 1/1993 Shimizu
5,195,676 A 3/1993 LeBras
5,197,598 A 3/1993 Stout et al.
5,246,112 A 9/1993 Stout et al.
5,246,122 A 9/1993 Schick et al.
5,297,673 A 3/1994 Sutherland
5,310,050 A 5/1994 Sutherland
5,311,984 A 5/1994 Harris
5,328,080 A 7/1994 Holley, Jr.
5,351,878 A 10/1994 Cooper
5,381,891 A 1/1995 Harriw
5,395,043 A 3/1995 Bacques et al.
5,398,870 A 3/1995 Bienaime
5,421,458 A 6/1995 Campbell
5,437,363 A 8/1995 Gungner
5,443,203 A * 8/1995 Sutherland ..... 229/198.2
5,472,090 A 12/1995 Sutherland
5,472,138 A 12/1995 Ingram
5,485,915 A 1/1996 Harris
5,505,372 A 4/1996 Edson et al.
5,520,283 A 5/1996 Sutherland
5,524,756 A 6/1996 Sutherland
5,542,536 A 8/1996 Sutherland
5,551,556 A 9/1996 Sutherland
5,558,212 A 9/1996 Sutherland
5,558,213 A 9/1996 Sutherland
5,588,586 A 12/1996 Negelen
5,597,071 A 1/1997 Sutherland
5,605,228 A 2/1997 Baxter
5,609,251 A 3/1997 Harris
5,638,956 A 6/1997 Sutherland
5,647,483 A 7/1997 Harris
5,653,341 A 8/1997 Miret
5,664,401 A 9/1997 Portrait et al.
5,671,845 A 9/1997 Harris
5,682,995 A 11/1997 Sutherland
5,692,614 A 12/1997 Harris
5,704,542 A 1/1998 Harrelson
5,765,685 A 6/1998 Roosa
5,778,630 A 7/1998 Portrait et al.
5,782,343 A * 7/1998 Harrelson ..... 206/140
5,853,088 A 12/1998 Saulas et al.
5,855,318 A 1/1999 Baxter
5,868,308 A 2/1999 Briand
5,924,628 A 7/1999 Oliff
5,931,300 A 8/1999 Sutherland
5,937,620 A 8/1999 Chalendar
5,941,389 A 8/1999 Gomes
5,941,453 A 8/1999 Oliff
5,943,847 A 8/1999 Chalendar
5,947,367 A 9/1999 Miller et al.
5,957,289 A 9/1999 Negelen
5,975,286 A 11/1999 Oliff
6,019,220 A 2/2000 Sutherland
6,021,898 A 2/2000 Sutherland
6,021,899 A 2/2000 Sutherland
6,085,969 A 7/2000 Burgoyne
6,109,438 A 8/2000 Sutherland
6,155,480 A 12/2000 Botsford et al.
6,158,586 A 12/2000 Muller
6,173,889 B1 1/2001 Sutherland
6,227,367 B1 5/2001 Harrelson et al.
6,283,293 B1 9/2001 Lingamfelter
6,289,651 B1 9/2001 Le Bras
6,315,123 B1 11/2001 Ikeda
6,378,697 B1 4/2002 Sutherland et al.
6,378,765 B1 4/2002 Sutherland
6,415,917 B1 7/2002 Marco
6,527,108 B1 3/2003 Blin et al.
6,550,616 B2 4/2003 Le Bras
6,736,260 B2 5/2004 Gomes et al.
6,789,673 B2 9/2004 Lingamfelter
6,811,525 B2 11/2004 Culpepper
6,866,185 B2 3/2005 Harrelson
6,877,600 B2 4/2005 Sutherland
6,946,651 B1 9/2005 Bohne
6,948,651 B2 9/2005 Ikeda
6,981,631 B2 1/2006 Fogle et al.
6,988,617 B2 1/2006 Gomes et al.
7,007,800 B2 3/2006 LeBras
7,025,197 B2 4/2006 Sutherland
7,159,759 B2 1/2007 Sutherland
7,175,020 B2 2/2007 Sutherland et al.
7,222,777 B2 5/2007 Garnier
7,380,701 B2 * 6/2008 Fogle et al. ..... 229/103.2
7,427,010 B2 9/2008 Sutherland
7,448,492 B2 11/2008 Sutherland
7,644,817 B2 1/2010 Sutherland

(56) References Cited

U.S. PATENT DOCUMENTS

| | | | |
|---|---|---|---|
| 7,677,387 | B2 | 3/2010 | Brand et al. |
| 7,762,395 | B2 | 7/2010 | Sutherland et al. |
| 7,762,397 | B2 | 7/2010 | Coltri-Johnson et al. |
| 7,832,183 | B2 | 11/2010 | Jacob et al. |
| 7,900,815 | B2 | 3/2011 | Shmagin |
| 7,913,844 | B2 | 3/2011 | Spivey, Sr. |
| 8,083,061 | B2 | 12/2011 | Fogel et al. |
| 8,317,082 | B2 | 11/2012 | May et al. |
| 2003/0000182 | A1 | 1/2003 | Portrait et al. |
| 2003/0132130 | A1 | 7/2003 | Le Bras |
| 2004/0000582 | A1 | 1/2004 | Sutherland |
| 2004/0011674 | A1 | 1/2004 | Theelen |
| 2004/0069659 | A1 | 4/2004 | Sutherland |
| 2004/0089671 | A1 | 5/2004 | Miller |
| 2004/0188277 | A1 | 9/2004 | Auclair |
| 2004/0188301 | A1 | 9/2004 | Gomes |
| 2004/0243277 | A1 | 12/2004 | Bonnain et al. |
| 2004/0254666 | A1 | 12/2004 | Bonnain et al. |
| 2005/0001020 | A1 | 1/2005 | Garnier |
| 2005/0103652 | A1 | 5/2005 | Wilkins |
| 2005/0167290 | A1 | 8/2005 | Sutherland |
| 2005/0178791 | A1 | 8/2005 | Miller |
| 2005/0194430 | A1 | 9/2005 | Auclair et al. |
| 2006/0157545 | A1 | 7/2006 | Auclair |
| 2006/0191811 | A1 | 8/2006 | Fogle et al. |
| 2006/0255108 | A1 | 11/2006 | Shmagin |
| 2007/0017829 | A1 | 1/2007 | Sutherland |
| 2007/0241017 | A1 | 10/2007 | Sutherland et al. |
| 2010/0072267 | A1 | 3/2010 | May |
| 2012/0267426 | A1 | 10/2012 | Hendricks et al. |

FOREIGN PATENT DOCUMENTS

| | | | |
|---|---|---|---|
| DE | 91 04905.9 | | 6/1991 |
| DE | 92 03 858.1 | | 5/1992 |
| EP | 0 242 992 | A2 | 11/1969 |
| EP | 0 159 172 | A2 | 10/1985 |
| EP | 0 459 658 | | 12/1991 |
| EP | 0 509 749 | | 10/1992 |
| EP | 0 520 411 | | 12/1992 |
| EP | 0 388 238 | B1 | 6/1993 |
| FR | 2 698 074 | | 5/1994 |
| GB | 1 172 430 | | 11/1969 |
| JP | 41-18199 | | 10/1965 |
| JP | 61-2545 | | 1/1986 |
| JP | 62-231736 | | 10/1987 |
| JP | 5-112373 | | 5/1993 |
| JP | 11-70969 | | 3/1999 |
| JP | 2003-252323 | | 9/2003 |
| JP | 2009-120248 | | 6/2009 |
| JP | 2010-58790 | | 3/2010 |
| WO | WO 97/27124 | | 7/1997 |
| WO | WO 98/09871 | | 3/1998 |
| WO | WO 99/11538 | | 3/1999 |
| WO | WO 00/78634 | | 12/2000 |
| WO | WO 02/102208 | | 12/2002 |
| WO | WO 03/008292 | | 1/2003 |
| WO | WO 2004/087507 | | 10/2004 |
| WO | WO 2005/092735 | | 10/2005 |
| WO | WO 2005/042370 | | 12/2005 |
| WO | WO 2007/126977 | | 11/2007 |
| WO | WO 2009/015320 | | 1/2009 |

OTHER PUBLICATIONS

International Search Report and Written Opinion for PCT/US2012/037465 dated Nov. 16, 2012.

International Search Report and Written Opinion for PCT/US2012/034197, dated Oct. 16, 2012.

Notification of Reason for Refusal for JP 2014-506539 dated Feb. 17, 2015 and English translation.

* cited by examiner

CARRIER WITH LOCKING FEATURES

CROSS-REFERENCE TO RELATED APPLICATIONS

This application claims the benefit of U.S. Provisional Patent Application No. 61/517,479, filed Apr. 20, 2011.

INCORPORATION BY REFERENCE

The disclosure of U.S. Provisional Patent Application No. 61/517,479, which was filed on Apr. 20, 2011, is hereby incorporated by reference for all purposes as if presented herein in their entirety.

BACKGROUND OF THE DISCLOSURE

The present disclosure generally relates to locks for carriers for holding and dispensing food and beverage containers or other types of articles.

SUMMARY OF THE DISCLOSURE

In general, one aspect of the disclosure is directed to a carrier for holding a plurality of articles. The carrier comprises a plurality of panels that extend at least partially around an interior of the carton. The plurality of panels comprises a first bottom panel and a second bottom panel. At least one locking feature comprises a female locking feature in the first bottom panel and a male locking feature in the second bottom panel. The female locking feature comprises a locking flap, and the male locking feature comprises a retention feature. At least a portion of the male locking feature engages the female locking feature, and at least a portion of the locking flap at least partially engages the retention feature.

In another aspect, the disclosure is generally directed to a blank for forming a carrier for holding a plurality of articles. The blank comprising a plurality of panels comprising at least a first bottom panel and a second bottom panel. At least one female locking feature is in the first bottom panel, and the at least one female locking feature comprises a locking flap. At least one male locking feature is in the second bottom panel. The at least one male locking feature comprises a retention feature. At least a portion of the at least one male locking feature is for engaging the at least one female locking feature when the carrier is formed from the blank. At least a portion of the locking flap of the at least one female locking feature is for at least partially engaging the retention feature of the at least one male locking feature when the carrier is formed from the blank.

In another aspect, the disclosure is generally directed to a method of forming a carrier for holding a plurality of articles comprising. The method comprises obtaining a blank comprising a plurality of panels comprising at least a first bottom panel and a second bottom panel, at least one female locking feature in the first bottom panel, and at least one male locking feature in the second bottom panel. The at least one female locking feature comprises a locking flap, and the at least one male locking feature comprises a retention feature. The method further comprises forming an interior of the carrier at least partially defined by the plurality of panels. The forming the interior of the carrier comprises at least partially overlapping the first bottom panel and the second bottom panel. The method further comprises forming at least one locking feature comprising inserting at least a portion of the at least one male locking feature into the at least one female locking feature adjacent the locking flap and engaging at least a portion of the locking flap of the at least one female locking feature with the retention feature of the at least one male locking feature.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to various features for cartons, carriers, packages, containers, etc., that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., aluminum beverage cans) as disposed within the carrier embodiments. In this specification, the terms "lower," "bottom," "upper," and "top" indicate orientations determined in relation to fully erected and upright cartons.

Figure 1:
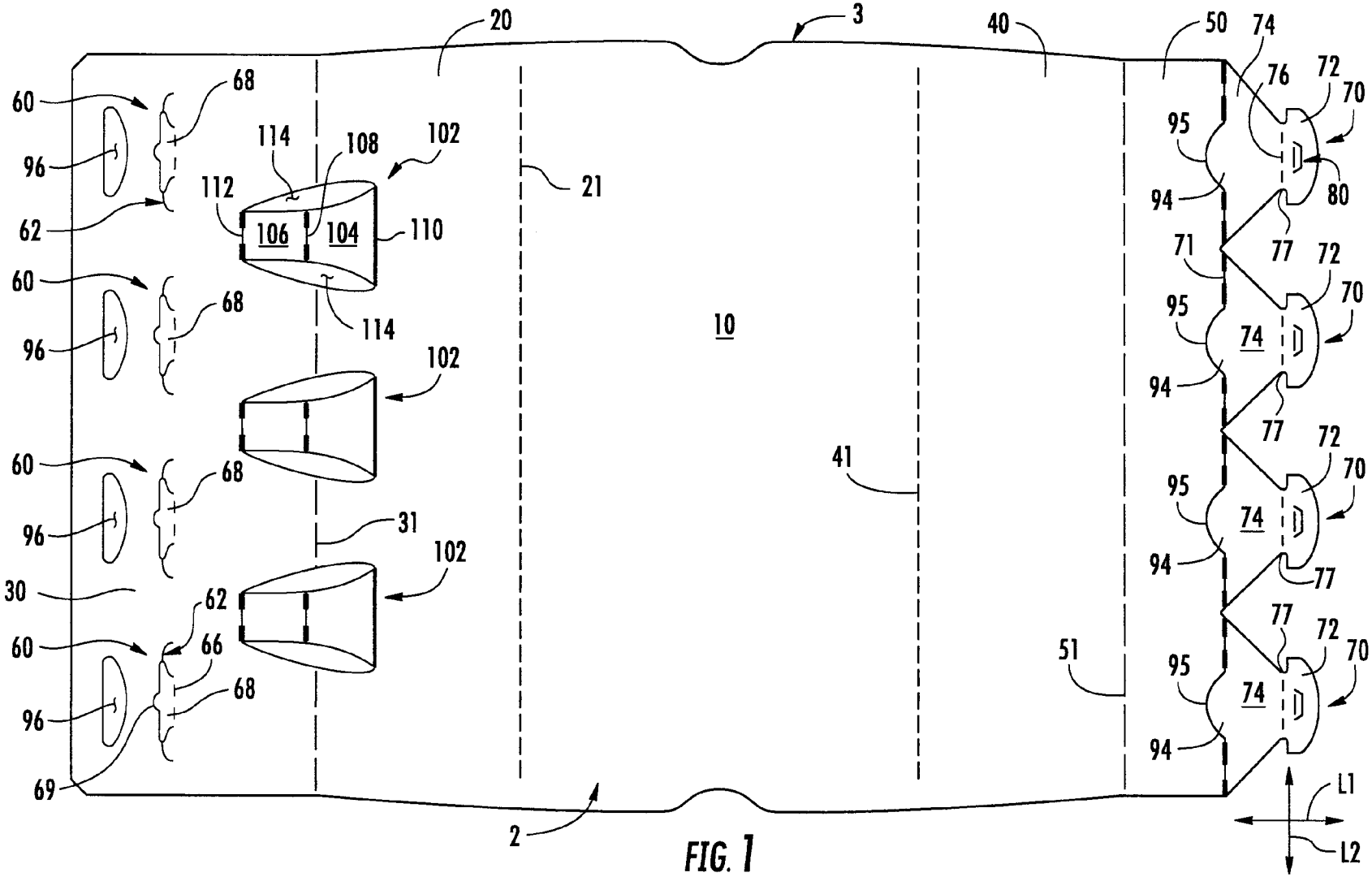
FIG. 1 is an exterior plan view of a blank for forming a carrier according to an exemplary embodiment of the present disclosure.
Figure 4A:
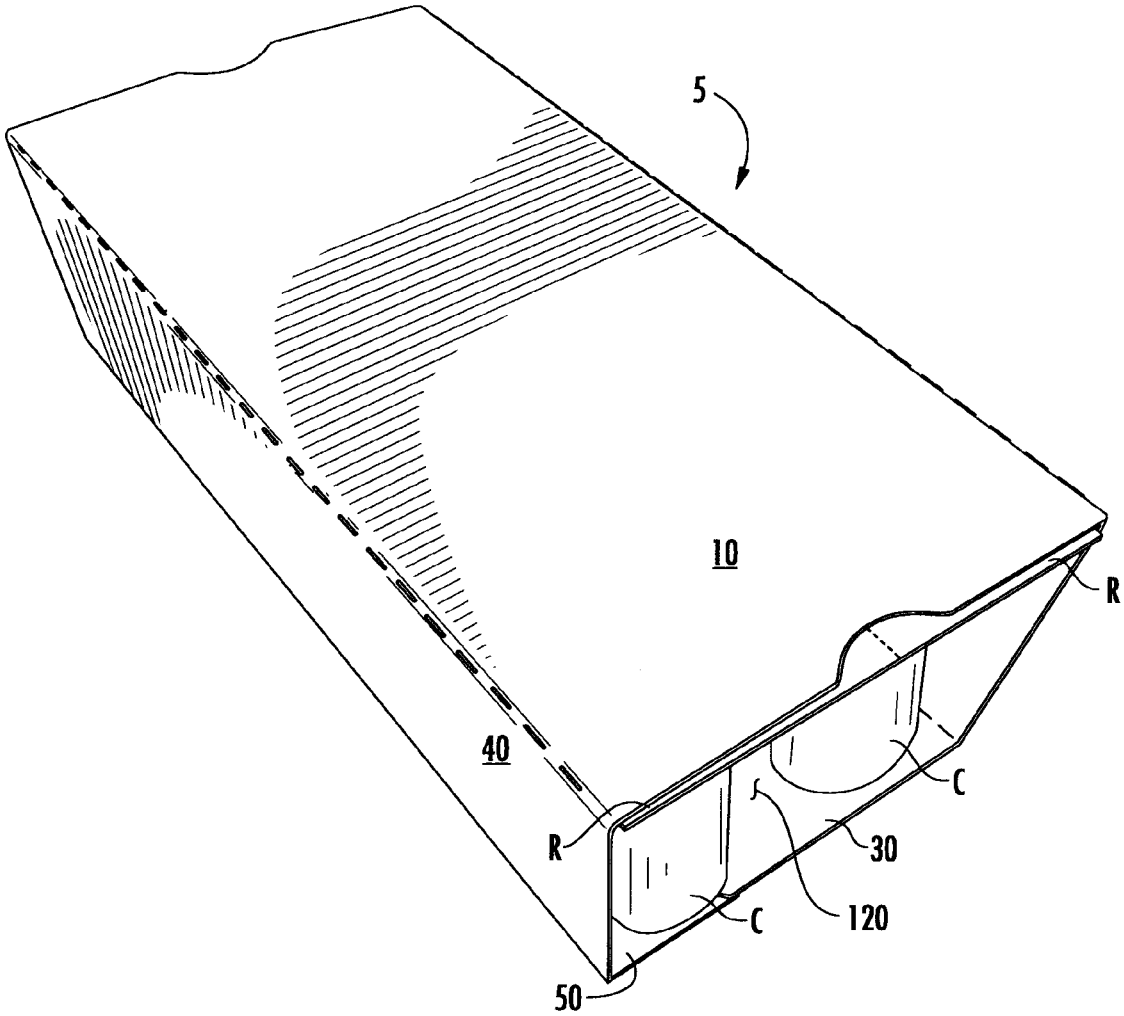
FIGS. 4A and 4B are perspective views of the carrier according to the exemplary embodiment of the present disclosure.
Figure 4B:
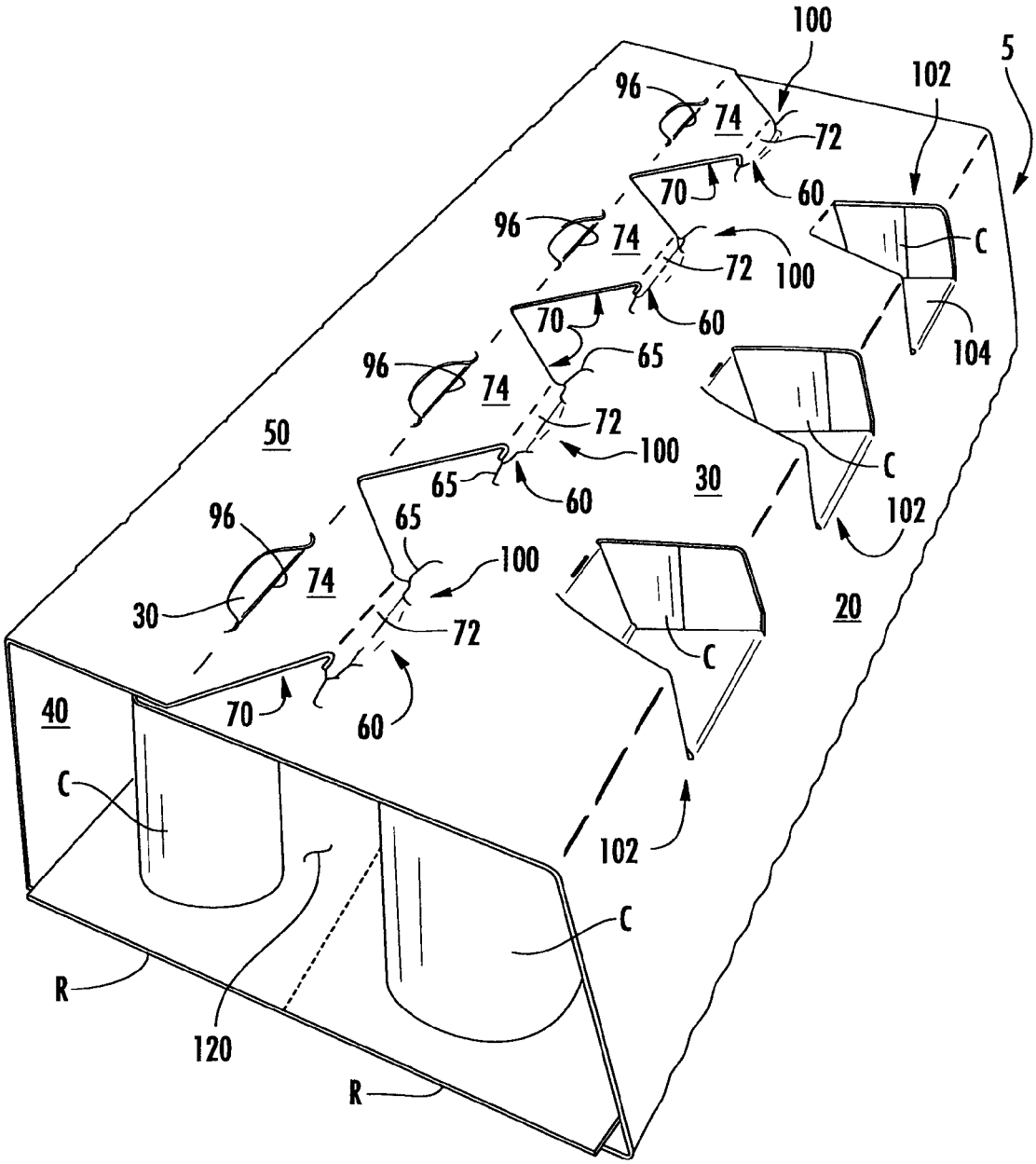

FIG. 1 is a plan view of an exterior surface 2 of a blank 3, used to form a carrier 5, shown in FIGS. 4A and 4B, according to one embodiment of the disclosure. The carrier 5 can be used to house a plurality of articles such as containers C. The containers C can be, for example, cups for holding a food product (e.g., yogurt) and can have interconnected rims R, which can be separable along perforated lines extending between adjacent containers C. Alternatively, the carrier 5 can hold beverage cans or other containers. In the illustrated embodiment, the blank 3 is sized to form a carrier 5 that houses eight containers in a single layer in a 2×4 arrangement. But, it is understood that the blank 3 and/or carrier may be sized and shaped to hold containers of a different or same quantity in more than one layer and/or in different row/column arrangements (e.g., 1×6, 2×6, 2×3, 2×2, 2×6×2, 2×4×2, 2×9, etc.). In the illustrated embodiment, the carrier 5 has generally open ends, and the carrier generally wraps around the containers (e.g., the carrier may be referred to as a wrap-around carrier). The carrier 5 could be otherwise shaped and arranged such the ends are at least partially closed such as by end flaps (not shown) or other closing mechanisms.

The blank 3 has a longitudinal axis L1 and a lateral axis L2. In the illustrated embodiment, the blank 3 comprises a top panel 10 foldably connected to a first side panel 20 at a first lateral fold line 21, a first bottom panel 30 foldably connected to the first side panel 20 at a second lateral fold line 31, a second side panel 40 foldably connected to the top panel 10 at a third lateral fold line 41, and a second bottom panel 50 foldably connected to the second side panel 40 at a fourth lateral fold line 51. The blank 3 can include front and/or rear gusset panels connected to respective panels 10, 20, 30, 40, 50 without departing from the scope of the disclosure.

In the illustrated embodiment, the lateral fold lines 21, 41 are perforation lines with relatively widely spaced perforations and each of the lateral fold lines 31, 51 is a series of one hundred percent cuts separated by relatively smaller nicks for generally easy folding relative to the fold lines 21, 41. In the present embodiment, the lateral fold lines 31, 51 can be subjected to less tension during the formation and use of the carrier 5 since the portions of the side panels 20, 40 and the bottom panels 30, 50 adjacent the fold lines 31, 51 are not generally pulled tightly against the bottoms of the containers C due to the relatively large rims R of the containers C. Accordingly, the lateral fold lines 31, 51 can be configured to fold more easily during formation of the carrier 5, which can cause the fold lines to be weaker, without substantial risk of tearing of the fold lines. Alternatively, the fold lines 21, 31, 41, 51 could be otherwise shaped, arranged, and/or configured without departing from the disclosure. For example, any of the fold lines 21, 31, 41, 51 can incorporate such features as scores, creases, nicks, cuts, perforations, and other fold line features, or combinations thereof.

Figure 3:
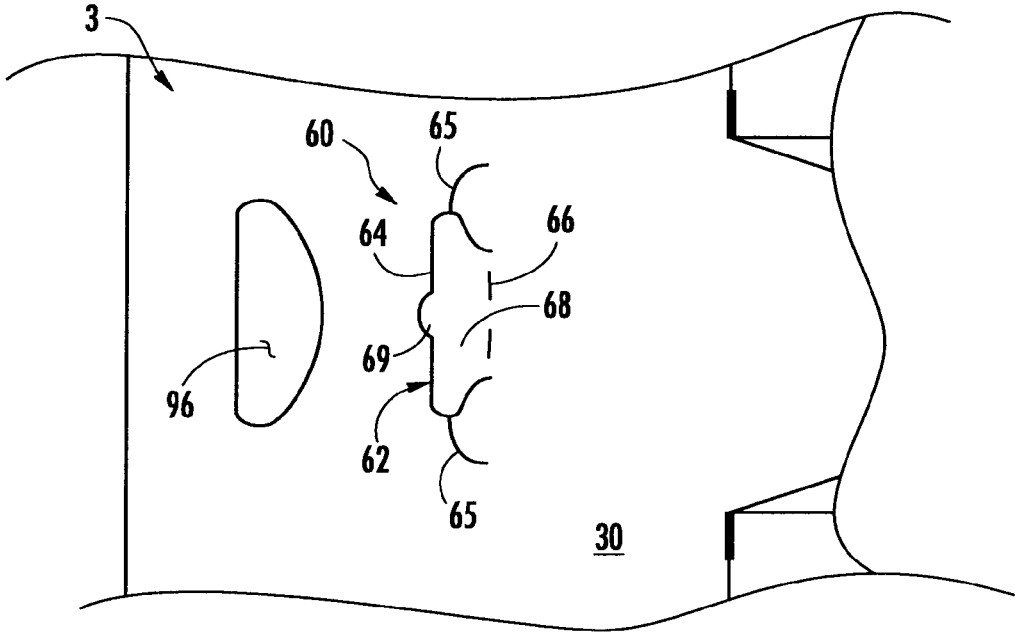
FIG. 3 is a view of a female locking feature of the blank of FIG. 1.
Figure 5:
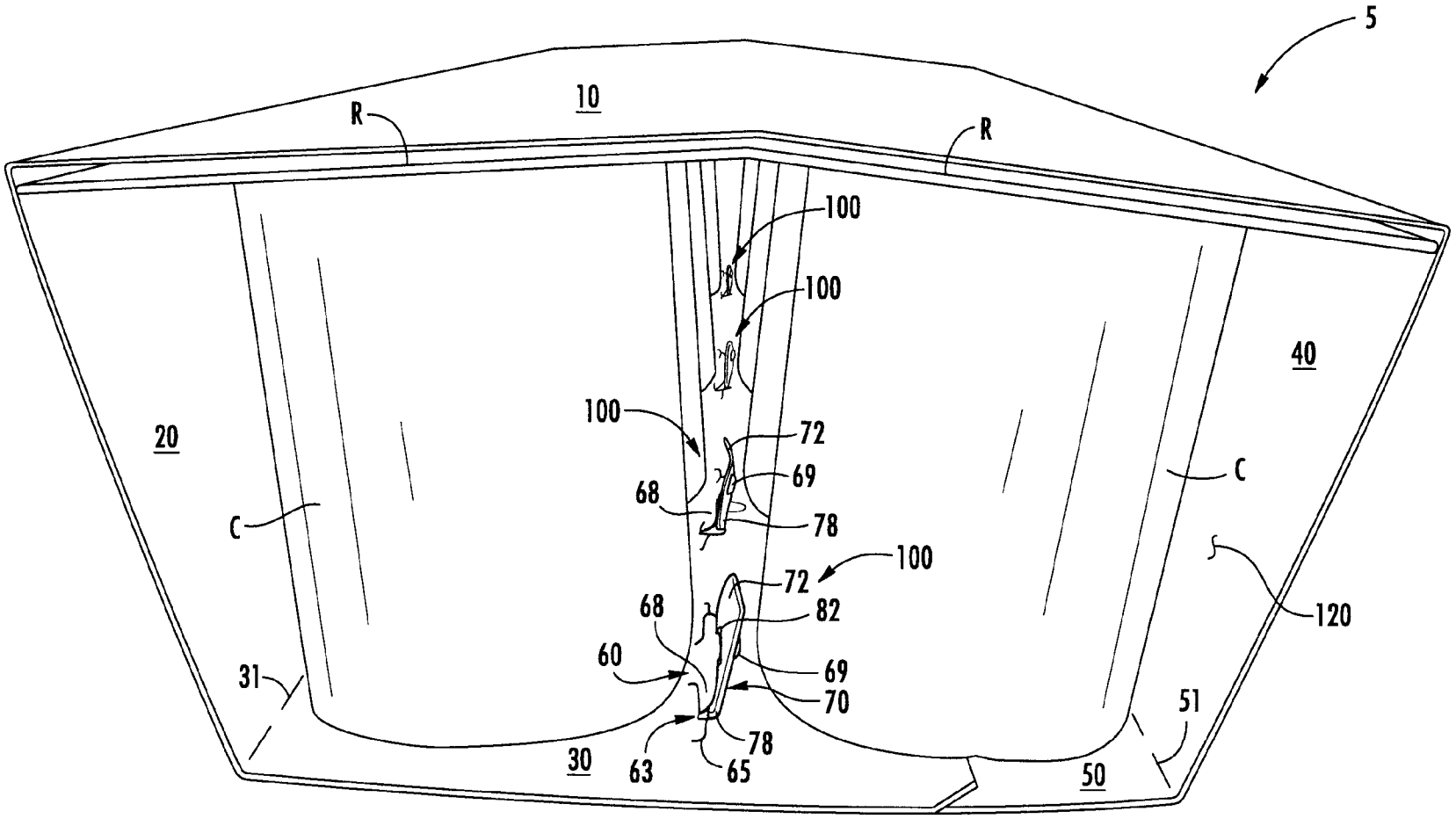
FIG. 5 is a perspective end view of the carrier of FIGS. 4A and 4B.

As shown in FIG. 1, the first bottom panel 30 can include primary female locking openings 96 and secondary female locking features 60. Each secondary female locking feature 60 can include a slit 62 forming a female locking opening 63 in the erected carrier 5 (FIG. 5). Each of the slits 62 extends generally laterally across the blank in the lateral direction L2. In the illustrated embodiment the slits 62 are not straight and include multiple turns, but the slits could be otherwise shaped without departing from the disclosure. As shown in FIG. 3, each of the slits 62 can include a central cut 64 and two end cut lines 65 extending from the central cut 64. The end cut lines 65 are generally arcuate as shown in FIG. 3; however, the end cut lines 65 could be otherwise shaped without departing from this disclosure. A fold line 66 generally extends between respective ends of the central cut 64 in each secondary female locking feature 60. In the illustrated embodiment the fold line 66 can be generally lateral and/or arcuate; however, the fold line could be otherwise shaped without departing from this disclosure. As shown in FIG. 3, the fold line 66 and the central cut 64 of the slit 62 can at least partially define a foldable locking flap 68 (broadly "opening flap") for each secondary female locking feature 60. The locking flaps 68 each include a retention tab or protrusion 69 at the respective free edge thereof, generally opposite to the respective fold line 66. When the locking flaps 68 are folded out of plane with the remaining portion of the first bottom panel 30, a respective female locking opening 63 is formed. The locking flaps 68 or other features of the secondary female locking features 60 could be otherwise shaped, arranged, and/or configured without departing from the disclosure. For example, the first bottom panel 30 can include any suitable number of female locking features 60.

Figure 2:
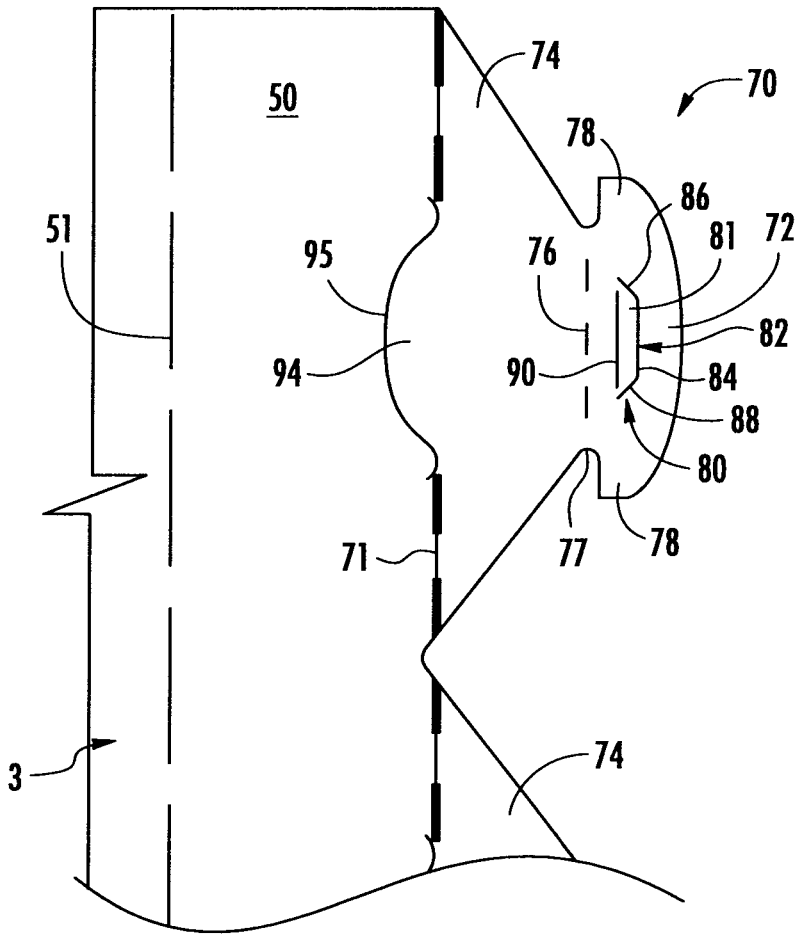
FIG. 2 is a view of a male locking feature of the blank of FIG. 1.

As shown in FIG. 1, the second bottom panel 50 can include primary male locking features 94 that are generally aligned with the primary female locking openings 96 in the first bottom panel 30 along respective longitudinal axes. Secondary male locking features 70 can extend from a main portion of the second bottom panel 50 and be foldably connected to the main portion along a fold line 71. In the illustrated embodiment, the fold line 71 is a cut-crease line; however, the fold line 71 could be any suitable line of weakening (e.g., fold line, crease line, score, cut, etc.) without departing from this disclosure. Each of the secondary male locking features 70 can include a male locking projection 72 and a proximal portion 74 extending between each male locking projection 72 and the fold line 71. The male locking projections 72 are generally aligned with and shaped for being received in a respective female locking feature 60. In the illustrated embodiment, each male locking projection 72 is foldably connected to the respective proximal portion 74 at a fold line 76 that extends across a narrow neck portion 77 of the secondary male locking feature 70. As shown in FIG. 2, the male locking projections 72 can have respective shoulders 78 that extend laterally outward from the narrow neck portion 77. The secondary male locking features 70 could be otherwise shaped, arranged, and/or configured without departing from the disclosure.

In the illustrated embodiment, as shown in FIG. 2, each of the male locking projections 72 has a retention feature 80 comprising a retention flap 81. The retention flap 81 can be formed by a retention cut 82 in the male locking projection 72. In one embodiment, the retention cut 82 has a lateral portion 84 and two oblique end portions 86, 88, but the retention cut 82 could be otherwise shaped, arranged, and/or configured to include other shapes (e.g., arcuate, orthogonal, straight, etc.). In one embodiment, the retention flap 81 is at least partially defined by a lateral cut 90 parallel to and spaced apart from the lateral portion 84 of the retention cut 82. The ends of the lateral cut 90 can be spaced apart from the respective ends of the oblique end portions 86, 88 of the retention cut 82. Accordingly, the lateral cut 90 can generally form a fold line and help facilitate folding of the retention flap 81 out of plane with the male locking projection 72. The lateral cut 90 could be lines of weakening other than a cut (e.g., fold line, crease line, cut/crease line, etc.) without departing from this disclosure.

Figure 2A:
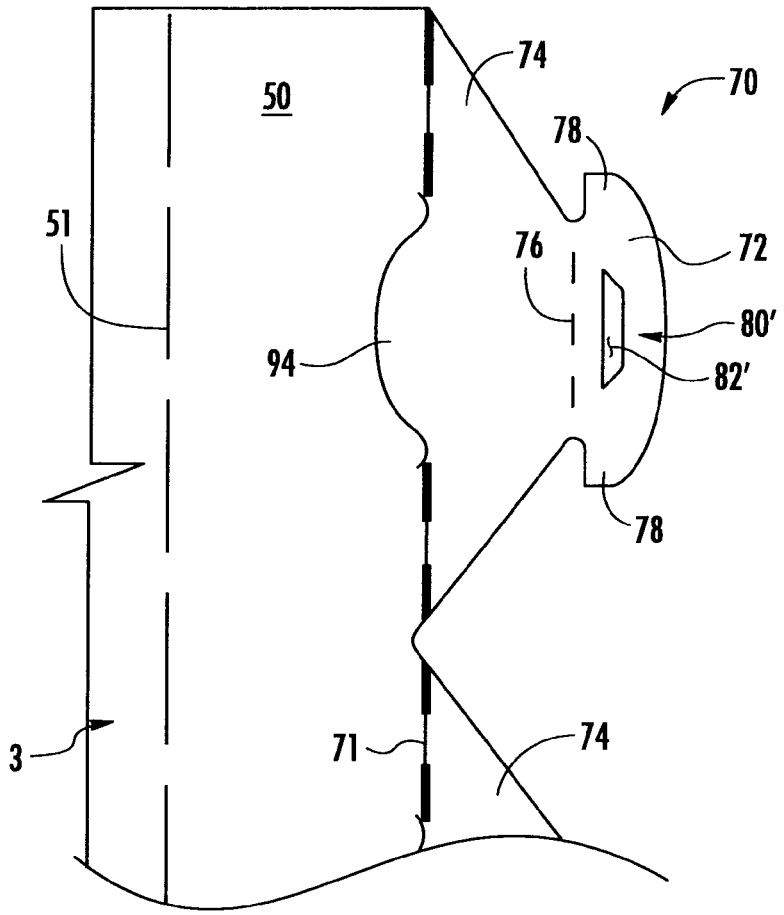
FIG. 2A is a view of an alternative male locking feature.

The retention features 80 can be otherwise shaped, arranged, and/or configured without departing from the disclosure. For example, as shown in FIG. 2A, one or more of the male locking projections 72 can include a retention feature 80' that defines an opening 82' for at least partially receiving the retention protrusion 69 of the locking flap 68.

As shown in FIGS. 1 and 2, the secondary female locking features 60 and the secondary male locking features 70 can be interlocked to form respective locking features 100 (FIGS. 4B-8) in the carrier 5 formed from the blank 3. The locking features 100 can be formed when the male locking projections 72 are inserted through the respective slits 62. The locking flaps 68 can fold upwardly to form the respective female locking openings 63, and the shoulders 78 of the male locking projections 72 can engage the end cut lines 65 of the slits 62 to help prevent withdrawal of the male locking projections 72. Accordingly, when the locking features 100 are formed, the shoulders 78 can be positioned above the first bottom panel 30 proximate the respective end cut lines 65. The foldable flap 68 is also biased against the male locking projection 72 to help prevent disengagement of the male locking projection 72 with a respective female opening 63. In the illustrated embodiment, at least a portion of each locking flap 68 (e.g., retention protrusion 69) can at least partially engage the retention feature 80 in the respective male locking projection 72 to further help prevent disengagement of the secondary male locking features 70 from the secondary female locking features 60.

As shown in FIG. 2, each of the primary male locking projections 94 is at least partially defined by a curved cut 95 in the second bottom panel 50 so that the primary male locking projections 94 generally extend from the respective proximal portions 74 of the secondary male locking features 70. As the secondary male locking features 70 are pivoted along the fold line 71, the primary male locking projections 94 can pivot out of the plane of the second bottom panel 50 in the opposite direction to the respective proximal portions 74. For example, the proximal portions 74 can be folded downwardly along the lateral fold line 71 causing the primary male locking projections 94 to pivot upwardly with respect to the remainder of the second bottom panel 50. In the illustrated embodiment, the primary male locking projections 94 and the primary female locking openings 96 are generally aligned with the respective secondary male locking features 70 and secondary female locking features 60 in the blank 3. However, the primary male locking projections 94 and the primary female locking openings 96 can be generally offset from the secondary male locking features 70 and the secondary female locking features 60 without departing from the disclosure.

As shown in FIG. 1, the blank 3 optionally can include knee locks or push-in features 102 extending in the first side panel 20 and the first bottom panel 30, generally aligned with the second lateral fold line 31. Each of the push-in features 102 can include a first push-in panel 104 foldably connected to a second push-in panel 106 along a lateral fold line 108. In the illustrated embodiment, the lateral fold lines 108 are offset from the second lateral fold line 31 towards the first bottom panel 30. The first push-in panel 104 and the second push-in panel 106 of each of the push-in features 102 can be foldably connected to the respective first side panel 20 and first bottom panel 30 along respective lateral fold lines 110, 112. In the illustrated embodiment, the lateral fold lines 108, 112 can be cut-crease lines (e.g., creases or scores extending from the ends of a cut) and the lateral fold line 110 can be a score or crease. Alternatively, the lateral fold lines 108, 110, 112 could be any suitable lines of weakening (e.g., fold line, crease line, cut/crease line, score, cut, etc.) without departing from this disclosure. The push-in features 102 can include openings 114 disposed on either side of the push-in panels 104, 106. The push-in features 102 could be omitted or otherwise shaped, arranged, and/or configured without departing from the disclosure. For example, the blank 3 could include any suitable number of push-in features 102. Additionally, push-in features 102 could extend in the second side panel 40 and the second bottom panel 50 in addition to or instead of the push-in features 102 in the first side panel 20 and the first bottom panel 30.

As shown in FIGS. 4A-8, the carrier 5 is formed from the blank 3 by wrapping the blank 3 around the containers C and overlapping the first and second bottom panels 30, 50 to at least partially form an interior 120 of the carrier 5. In the illustrated embodiment, the top panel 10 is placed on the interconnected rims R of the container C, the side panels 20, 40 are folded downwardly along respective lateral fold lines 21, 41, and the bottom panels 30, 50 are inwardly folded along respective fold lines 31, 51 so that the first bottom panel 30 generally overlaps the second bottom panel 50. In one embodiment, as the first bottom panel 30 is folded along the second lateral fold line 31, the push-in features 102 are pushed inwardly between the respectively adjacent containers C, as shown in FIG. 4B. Accordingly, the push-in panels 104, 106 are folded along fold lines 108, 110, 112 so that the push-in panel 104 is generally horizontal and the push-in panel 106 is generally vertical in the interior 120 of the carrier 5. The push-in panels 104, 106 can help prevent the containers C, which are connected at the rims R, from translating laterally in the carrier 5 to help prevent the containers from sliding out of the carrier 5 through the open ends. The push-in features 102 can be otherwise formed and can otherwise interface with the containers C without departing from the disclosure.

In the illustrated embodiment, the bottom panels 30, 50 can be interlocked by engaging the primary male locking projections 94 with the primary female locking openings 96 and inserting the male locking projections 72 into the female locking openings 63. In one particular embodiment, the secondary male locking features 70 are folded downwardly along the lateral fold line 71 causing the primary male locking projections 94 to pivot upwardly relative to the remainder of the second side panel 50. The primary male locking projections 94 can be inserted into the primary female locking openings 96. The male locking projections 72 can be folded upwardly along the fold lines 76 to be generally perpendicular to the respective proximal portions 74 of the secondary male locking features 70, and the proximal portions 74 can be folded upwardly along the lateral fold line 71 and into face-to-face contact with the first bottom panel 30. Accordingly, the male locking projections 72 are engaged with the secondary female locking features 60. Particularly, the male locking projections 72 can be inserted into the slits 62 so that the leading edges of the male locking projections 72 press against the respective locking flaps 68 to fold them upwardly about the fold lines 66, forming the female locking openings 63. The first bottom panel 30 can separate somewhat adjacent the end cut lines 65 to allow the male locking projections 72 to pass through the slits 62.

Figure 6:
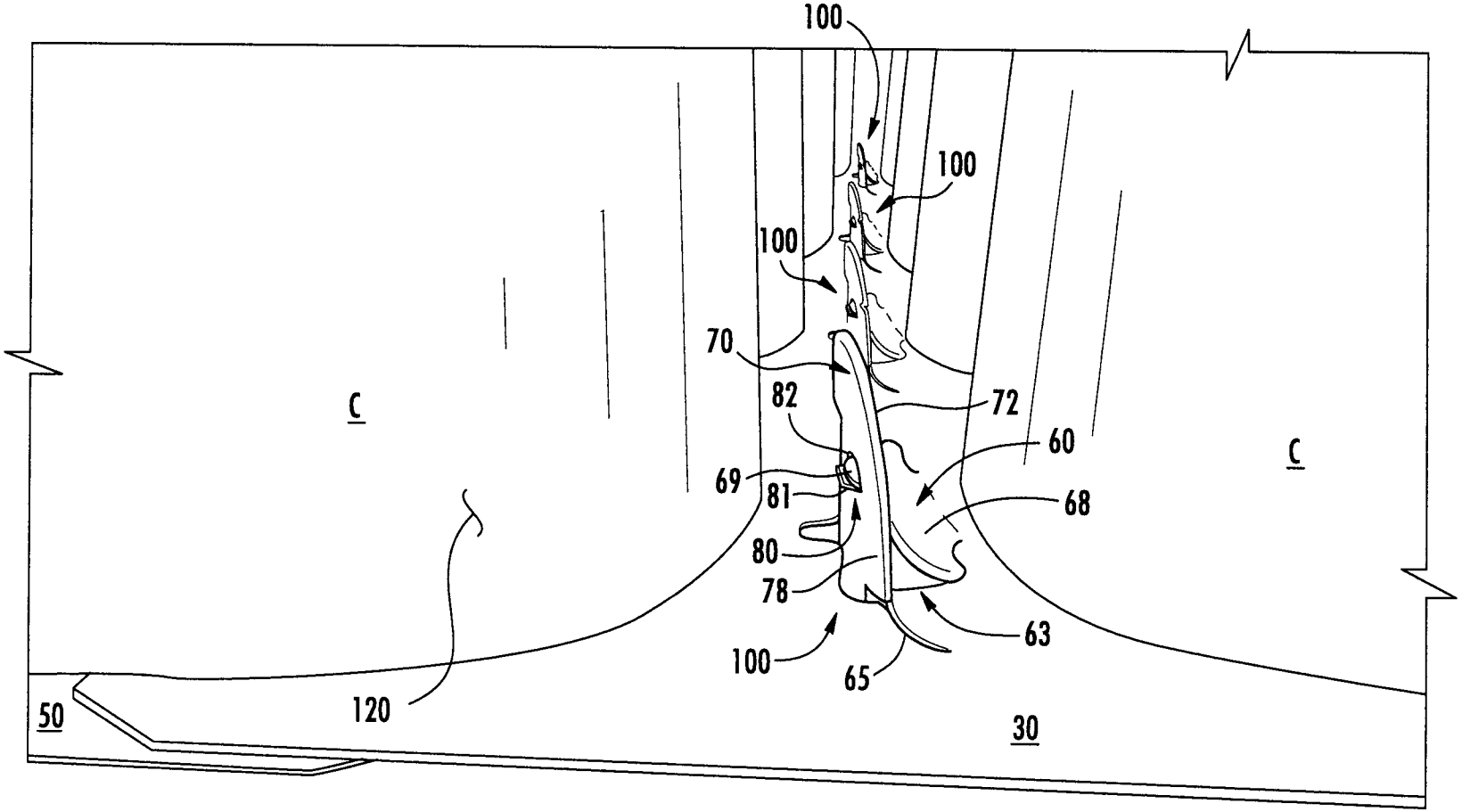
FIGS. 6 and 7 are perspective views of a locking feature of the carrier according to the exemplary embodiment of the present disclosure.
Figure 7:
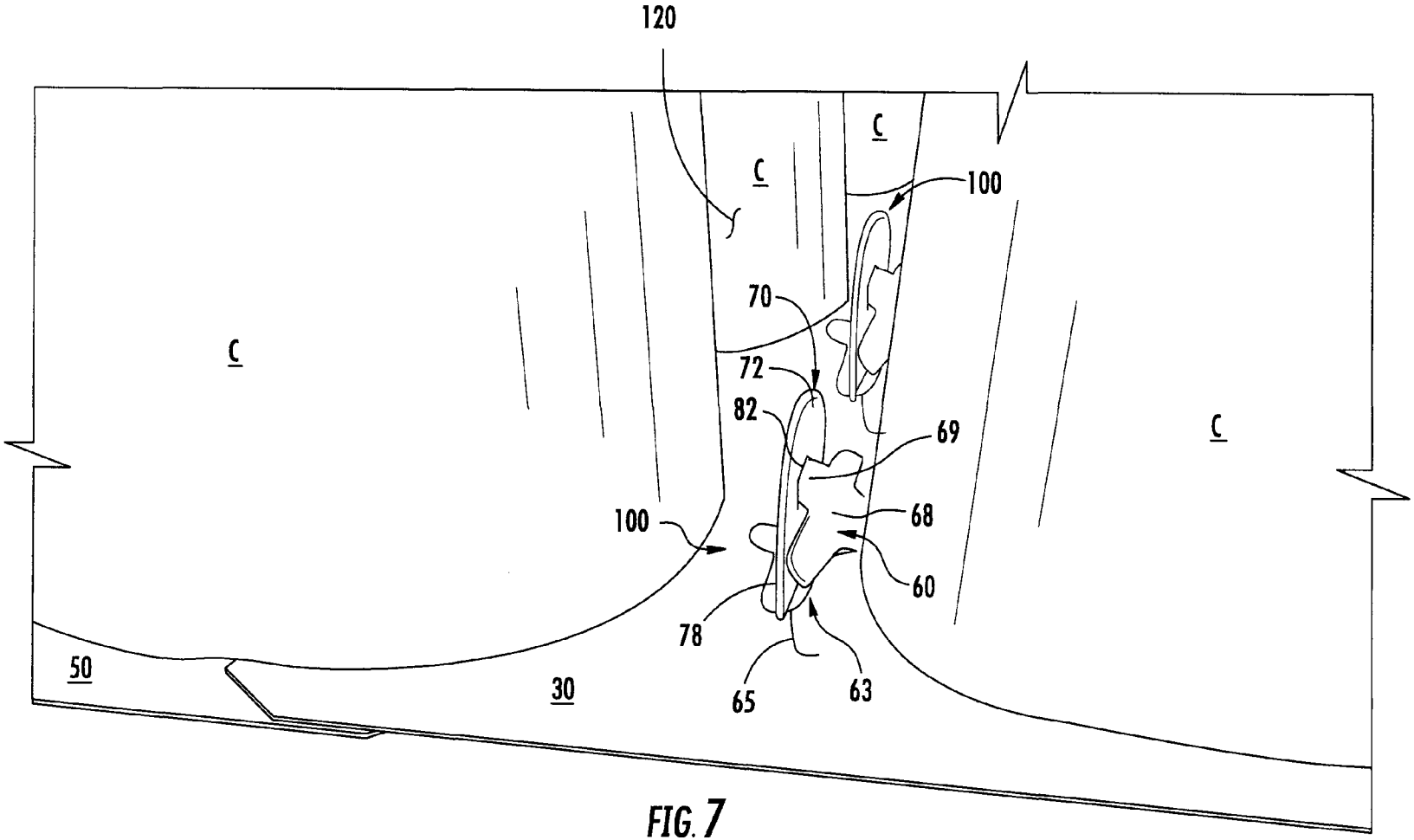

In the illustrated embodiment, when the proximal portions 74 are in face-to-face contact with the first bottom panel 30, the respective male locking projections 72 are fully inserted into the secondary female locking features 60 so that the narrow neck portion 77 is disposed in the female locking opening 63 and the shoulders 78 are disposed above the first bottom panel 30 proximate the end cut lines 65 (FIGS. 6 and 7). When the bottom panels 30, 50 are positioned in their final, locked and loaded orientation, the shoulders 78 can be out of alignment with the cuts 62 in the first bottom panel 30 so that the shoulders contact a portion of the first bottom panel 30 to help prevent withdrawal of the male locking projections 72 from the female locking openings 63. The male locking projections 72 can interact and engage the female locking openings 63 by other positioning steps or alternative features and/or arrangements without departing from the disclosure.

Figure 8:
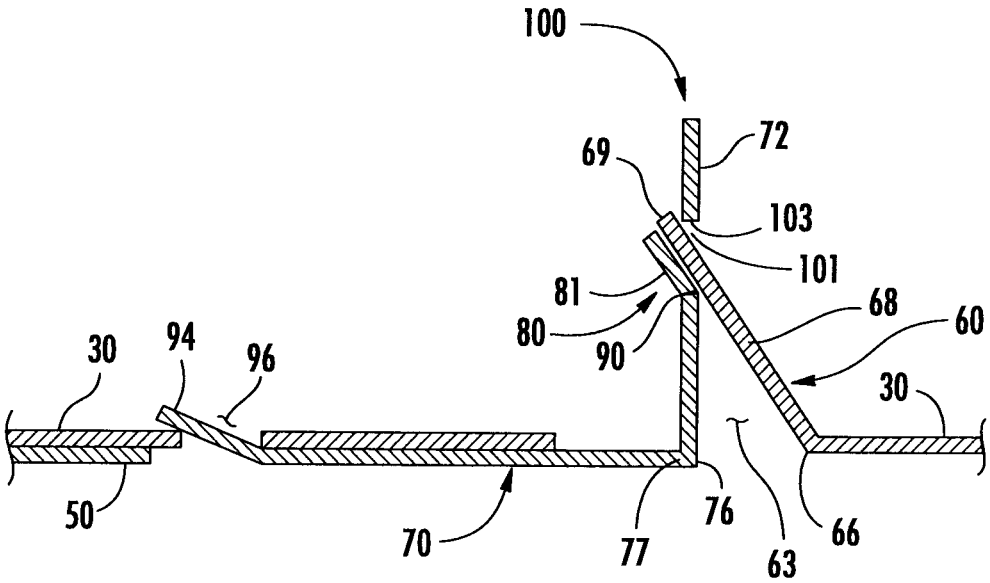
FIG. 8 is a cross-sectional view of the locking feature of FIGS. 6 and 7.

In one embodiment, the male locking projections 72 are held in a generally upright position in the inside of the carrier 5 relative to the first and second bottom panels 30, 50 by the engagement of the locking flaps 68 with the retention feature 80 of a respective male locking projection 72. As shown in FIGS. 6-8, the foldable flaps 68 are folded upward relative to the bottom panel 30 and the retentions protrusions 69 at the free edges of the locking flaps are pressed against the retention flaps 81 causing them to fold out of plane with the rest of the respective male locking projections 72. As shown in FIG. 8, the retention protrusion 69 is inserted through the opening 101 in the male locking projection caused by folding the retention flap 81 at fold line 90. Alternatively, the retention feature 80' of FIG. 2A can be used, wherein the retention protrusion 69 is inserted through the opening 82' in the male locking projection 72. The engagement of the retention protrusion 69 with the edge 103 of the male locking projection 72 at the opening 101 assists in maintaining the male locking projections in the upright position. For example, when one of the male locking projections 72 is pushed or pulled toward a respective female locking opening 63, the edge 103 engages the retention protrusion 69 of the locking flap 68, which can push against the first bottom panel 30 at the fold line 66 to help resist the movement of the male locking projection 72 toward the female locking opening 63. The secondary male locking features 70 can be locked or engaged with the female locking features 60 by otherwise positioning the aspects and features of the blank 3 without departing from the disclosure.

In one embodiment, the engagement between the retention protrusions 69 with retention features 80, 80' can help hold the locking features 100 together even under some movement of the bottom panels 30, 50. For example, as shown in FIG. 5, the side panels 20, 40 can be in close contact and/or pulled tightly against the rims R of the containers C adjacent the respective fold lines 21, 41. The bottoms of the containers C can be generally smaller than the rims R, so the portions of the side panels 20, 40 and the bottom panels 30, 50 adjacent the respective fold lines 31, 51 can be spaced apart from the containers C. This spacing can lead to some relative movement of the bottom panels 30, 50, which could help force the male locking projections 72 toward the female locking openings 63. However, the engagement of the retention protrusion 69 of the locking flap 68 with the retention feature 80 for each locking feature 100 can help prevent the male locking projections 72 from withdrawing from the respective locking opening 63.

In an alternative embodiment, the carrier 5 can include one or more locking features 100 as described above in conjunction with a suitable number alternative locking features (not shown) to interlock the bottom panels 30, 50.

In general, the blank may be constructed from paperboard having a caliper (e.g., 14-point board) so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of articles, the carrier comprising:

a plurality of panels that extend at least partially around an interior of the carton, the plurality of panels comprising a first bottom panel and a second bottom panel;

at least one locking feature comprising a female locking feature in the first bottom panel and a male locking feature in the second bottom panel, the female locking feature comprising a locking flap that is foldably connected to the first bottom panel along a fold line, and the male locking feature comprising a retention feature, at least a portion of the male locking feature engaging the female locking feature, and at least a portion of the locking flap at least partially engaging the retention feature, wherein the locking flap is oblique with respect to at least a portion of the male locking feature and the first bottom panel.

2. The carrier of claim 1, wherein the female locking feature further comprises a slit extending in the first bottom panel, the slit at least partially defining the locking flap.

3. The carrier of claim 2, wherein the locking flap comprises a retention tab disposed generally opposite to the fold line, the retention tab at least partially engaging the retention feature of the male locking feature.

4. The carrier of claim 2, wherein the male locking feature comprises a male locking projection extending through the slit in the first bottom panel, the retention feature extending in the male locking projection.

5. The carrier of claim 4, wherein the retention feature is a retention cut that at least partially defines a retention flap in the male locking projection.

6. The carrier of claim 5, wherein the retention flap is foldably connected to the male locking projection along a generally lateral fold line, and the retention cut comprises two oblique end portions extending from respective ends of a generally lateral portion.

7. The carrier of claim 4, wherein the male locking feature comprises a proximal portion foldably connected to a main portion of the second bottom panel along a first fold line, the male locking projection being foldably connected to the proximal portion along a second fold line, the first bottom panel at least partially overlapping the proximal portion and the male locking projection extending generally upwardly from the proximal portion.

8. The carrier of claim 7, wherein the female locking feature further comprises a first end cut line and a second end cut line each extending from the slit in the first bottom panel, and the male locking projection comprises a first shoulder and a second shoulder each extending proximate respective ends of the second fold line, the first shoulder and the second shoulder being positioned above the first bottom panel proximate the respective first end cut line and second end cut line.

9. The carrier of claim 7, wherein the at least one locking feature comprises at least one secondary locking feature, the carrier further comprising at least one primary locking feature comprising a primary male locking projection at least partially defined by a primary cut in the second bottom panel and a primary female locking opening in the first bottom panel, the primary male locking projection being pivotable relative to the second bottom panel along the first fold line and at least partially engaging the primary female locking opening.

10. The carrier of claim 1, wherein:

the plurality of panels further comprises a top panel, a first side panel foldably connected to the top panel along a first fold line, a second side panel foldably connected to the top panel along a second fold line;

the first bottom panel is foldably connected to the first side panel along a third fold line, and the second bottom panel is foldably connected to the second side panel along a fourth fold line; and the third fold line and the fourth fold line each comprises a plurality of cuts and nicks.

11. The carrier of claim 10, wherein each of the third fold line and the fourth fold line is easier to fold than each of the first fold line and the second fold line.

12. The carrier of claim 1, wherein the retention feature of the male locking feature is spaced apart from the first bottom panel.

13. The carrier of claim 1, wherein the fold line is a first fold line, the male locking feature comprises a proximal portion and a male locking projection foldably connected to the proximal portion along a second fold line, the retention feature of the male locking feature extends in the male locking projection, and the retention feature is spaced apart from the fold line.

14. A carrier for holding a plurality of articles, the carrier comprising:

a plurality of panels that extend at least partially around an interior of the carton, the plurality of panels comprising a first bottom panel and a second bottom panel;

at least one locking feature comprising a female locking feature in the first bottom panel and a male locking feature in the second bottom panel, the female locking feature comprising a locking flap, and the male locking feature comprising a retention feature, at least a portion of the male locking feature engaging the female locking feature, and at least a portion of the locking flap at least partially engaging the retention feature, wherein the locking flap is oblique with respect to at least a portion of the male locking feature and the first bottom panel;

wherein the female locking feature further comprises a slit extending in the first bottom panel, the slit at least partially defining the locking flap;

wherein the male locking feature comprises a male locking projection extending through the slit in the first bottom panel, the retention feature extends in the male locking projection, and the retention feature comprises an opening in at least the male locking projection.

15. A carrier for holding a plurality of articles, the carrier comprising:

a plurality of panels that extend at least partially around an interior of the carton, the plurality of panels comprising a first side panel, a second side panel, a first bottom panel, and a second bottom panel, the first bottom panel being foldably connected to the first side panel, and the second bottom panel being foldably connected to the second side panel;

at least one locking feature comprising a female locking feature in the first bottom panel and a male locking feature in the second bottom panel, the female locking feature comprising a locking flap, and the male locking feature comprising a retention feature, at least a portion of the male locking feature engaging the female locking feature, and at least a portion of the locking flap at least partially engaging the retention feature, wherein the locking flap is oblique with respect to at least a portion of the male locking feature and the first bottom panel; and a plurality of push-in features, each comprising a first push-in panel foldably connected to a second push-in panel, each first push-in panel being foldably connected to at least one of the first side panel and the second side panel and each second push-in panel being foldably connected to a respective one of the first bottom panel and second bottom panel, each push-in feature of the plurality of push-in features being for positioning between two adjacent articles of the plurality of articles.

16. A blank for forming a carrier for holding a plurality of articles, the blank comprising:

a plurality of panels comprising at least a first bottom panel and a second bottom panel;

at least one female locking feature in the first bottom panel, the at least one female locking feature comprising a locking flap that is foldably connected to the first bottom panel along a fold line; and at least one male locking feature in the second bottom panel, the at least one male locking feature comprising a retention feature, at least a portion of the at least one male locking feature being for engaging the at least one female locking feature when the carrier is formed from the blank, and at least a portion of the locking flap of the at least one female locking feature being for at least partially engaging the retention feature of the at least one male locking feature when the carrier is formed from the blank, wherein the locking flap is for extending in an oblique direction with respect to at least a portion of the male locking feature and the first bottom panel when the carrier is formed from the blank.

17. The blank of claim 16, wherein the at least one female locking feature further comprises a slit extending in the first bottom panel, the slit at least partially defining the locking flap.

18. The blank of claim 17, wherein the locking flap of the at least one female locking feature comprises a retention tab defined by a portion of the slit that is generally opposite to the fold line, the retention tab being for engaging the retention feature of the at least one male locking feature when the carrier is formed from the blank.

19. The blank of claim 17, wherein the at least one male locking feature comprises a male locking projection for extending through the slit in the first bottom panel when the carrier is formed from the blank, the retention feature of the at least one male locking feature extending in the male locking projection.

20. The blank of claim 19, wherein the retention feature of the at least one male locking feature is a retention cut that at least partially defines a retention flap in the male locking projection.

21. The blank of claim 20, wherein the retention flap is foldably connected to the male locking projection along a generally lateral fold line, and the retention cut comprises two oblique end portions extending from respective ends of a generally lateral portion.

22. The blank of claim 19, wherein the at least one male locking feature comprises a proximal portion foldably connected to a main portion of the second bottom panel along a first fold line, the male locking projection being foldably connected to the proximal portion along a second fold line.

23. The blank of claim 22, wherein the at least one female locking feature further comprises a first end cut line and a second end cut line each extending from the slit in the first bottom panel, and the male locking projection of the at least one male locking feature comprises a first shoulder and a second shoulder each extending proximate respective ends of the second fold line, the first shoulder and the second shoulder for being positioned above the first bottom panel proximate the respective first end cut line and second end cut line when the carrier is formed from the blank.

24. The blank of claim 22, wherein:

the at least one female locking feature is at least one secondary female locking feature, and the at least one male locking feature is at least one secondary male locking feature; and the blank further comprises at least one primary male locking projection at least partially defined by a primary cut in the second bottom panel and at least one primary female locking opening in the first bottom panel, the at least one primary male locking projection being pivotable relative to the second bottom panel along the first fold line and being for at least partially engaging the at least one primary female locking opening when the carrier is formed from the blank.

25. The blank of claim 16, wherein:

the plurality of panels further comprises a top panel, a first side panel foldably connected to the top panel along a first fold line, a second side panel foldably connected to the top panel along a second fold line;

the first bottom panel is foldably connected to the first side panel along a third fold line, and the second bottom panel is foldably connected to the second side panel along a fourth fold line; and the third fold line and the fourth fold line each comprises a plurality of cuts and nicks.

26. The blank of claim 25, wherein each of the third fold line and the fourth fold line is easier to fold than each of the first fold line and the second fold line.

27. The blank of claim 16, wherein the retention feature of the male locking feature is for being spaced apart from the first bottom panel when the carrier is formed from the blank.

28. The blank of claim 16, wherein the fold line is a first fold line, the male locking feature comprises a proximal portion and a male locking projection foldably connected to the proximal portion along a second fold line, the retention feature of the male locking feature extends in the male locking projection, and the retention feature is spaced apart from the fold line.

29. A blank for forming a carrier for holding a plurality of articles, the blank comprising:

a plurality of panels comprising at least a first bottom panel and a second bottom panel;

at least one female locking feature in the first bottom panel, the at least one female locking feature comprising a locking flap; and at least one male locking feature in the second bottom panel, the at least one male locking feature comprising a retention feature, at least a portion of the at least one male locking feature being for engaging the at least one female locking feature when the carrier is formed from the blank, and at least a portion of the locking flap of the at least one female locking feature being for at least partially engaging the retention feature of the at least one male locking feature when the carrier is formed from the blank, wherein the locking flap is for extending in an oblique direction with respect to at least a portion of the male locking feature and the first bottom panel when the carrier is formed from the blank;

wherein the at least one female locking feature further comprises a slit extending in the first bottom panel, the slit at least partially defining the locking flap;

wherein the retention feature of the at least one male locking feature is a retention cut that at least partially defines a retention flap in the male locking projection, and the retention feature of the at least one male locking feature comprises an opening in at least the male locking projection when the carrier is formed from the blank.

30. A blank for forming a carrier for holding a plurality of articles, the blank comprising:

a plurality of panels comprising at least a first side panel, a second side panel, a first bottom panel, and a second bottom panel, the first bottom panel being foldably connected to the first side panel, and the second bottom panel being foldably connected to the second side panel;

at least one female locking feature in the first bottom panel, the at least one female locking feature comprising a locking flap; and at least one male locking feature in the second bottom panel, the at least one male locking feature comprising a retention feature, at least a portion of the at least one male locking feature being for engaging the at least one female locking feature when the carrier is formed from the blank, and at least a portion of the locking flap of the at least one female locking feature being for at least partially engaging the retention feature of the at least one male locking feature when the carrier is formed from the blank, wherein the locking flap is for extending in an oblique direction with respect to at least a portion of the male locking feature and the first bottom panel when the carrier is formed from the blank; and a plurality of push-in features, each comprising a first push-in panel foldably connected to a second push-in panel, each first push-in panel being foldably connected to at least one of the first side panel and the second side panel and each second push-in panel being foldably connected to a respective one of the first bottom panel and second bottom panel, each push-in feature of the plurality of push-in features being for positioning between two adjacent articles of the plurality of articles when the carrier is formed from the blank.

31. A method of forming a carrier for holding a plurality of articles comprising:

obtaining a blank comprising a plurality of panels comprising at least a first bottom panel and a second bottom panel, at least one female locking feature in the first bottom panel, and at least one male locking feature in the second bottom panel, the at least one female locking feature comprising a locking flap, and the at least one male locking feature comprising a retention feature, wherein the locking flap of the at least one female locking feature comprising a retaining protrusion, and the retaining feature of the at least one male locking feature comprises a retaining cut;

forming an interior of the carrier at least partially defined by the plurality of panels, the forming the interior of the carrier comprising at least partially overlapping the first bottom panel and the second bottom panel; and forming at least one locking feature comprising inserting at least a portion of the at least one male locking feature into the at least one female locking feature adjacent the locking flap and engaging at least a portion of the locking flap of the at least one female locking feature with the retention feature of the at least one male locking feature so that the locking flap is oblique with respect to at least a portion of the male locking feature and the first bottom panel and inserting at least a portion of the retaining protrusion of the locking flap into the retaining cut of the retaining feature.

32. The method of claim 31, wherein the at least one female locking feature further comprises a slit extending in the first bottom panel, the slit at least partially defining the locking flap, the forming the at least one locking feature comprising inserting at least a portion of the at least one male locking feature through the slit.

33. The method of claim 32, wherein:

the at least one male locking feature comprises a proximal portion foldably connected to a main portion of the second bottom panel along a first fold line and a male locking projection foldably connected to the proximal portion along a second fold line, the retention feature of the at least one male locking feature extending in the male locking projection; and the forming the at least one locking feature further comprises folding the male locking projection along the second fold line and inserting the male locking projection at least partially through the slit of the at least one female locking feature in the first bottom panel.

34. The method of claim 33, wherein:

the at least one female locking feature is at least one secondary female locking feature, and the at least one male locking feature is at least one secondary male locking feature;

the blank further comprises at least one primary male locking projection at least partially defined by a primary cut in the second bottom panel and at least one primary female locking opening in the first bottom panel; and the method further comprises folding the proximal portion of the at least one secondary male locking feature along the first fold line away from the first bottom panel causing the at least one primary male locking projection to pivot out of plane with the second bottom panel and toward the first bottom panel, and inserting the at least one primary male locking projection at least partially into the at least one primary female locking opening.

35. The method of claim 31, wherein:

the plurality of panels further comprises a top panel, a first side panel foldably connected to the top panel along a first fold line, a second side panel foldably connected to the top panel along a second fold line;

the first bottom panel is foldably connected to the first side panel along a third fold line, and the second bottom panel is foldably connected to the second side panel along a fourth fold line; and the forming the interior of the carrier further comprises folding the first side panel and the second side panel downwardly along the respective first fold line and second fold line, and folding the first bottom panel and the second bottom panel inwardly along the respective third fold line and fourth fold line, each of the third fold line and the fourth fold line being configured so that the folding along the third fold line and the fourth fold line is easier than the folding of the first fold line and the second fold line.

36. The method of claim 31, wherein the retention feature of the male locking feature is spaced apart from the first bottom panel after the forming the at least one locking feature.

37. The method of claim 31, wherein the male locking feature comprises a proximal portion and a male locking projection foldably connected to the proximal portion along a fold line, the retention feature of the male locking feature extends in the male locking projection, and the retention feature is spaced apart from the fold line.

* * * * *